US012326158B2

(12) United States Patent
Brewer et al.

(10) Patent No.: US 12,326,158 B2
(45) Date of Patent: Jun. 10, 2025

(54) BLOWER UNIT FOR AN APPLIANCE

(71) Applicant: Haier US Appliance Solutions, Inc., Wilmington, DE (US)

(72) Inventors: Kyle James Brewer, Louisville, KY (US); Steven Chadwick Koepke, LaGrange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/360,357

(22) Filed: Jul. 27, 2023

(65) Prior Publication Data

US 2025/0035131 A1 Jan. 30, 2025

(51) Int. Cl.

| | |
|---|---|
| ***F04D 29/62*** | (2006.01) |
| ***A47L 15/42*** | (2006.01) |
| ***A47L 15/48*** | (2006.01) |
| ***F04D 17/08*** | (2006.01) |
| ***F04D 29/08*** | (2006.01) |

(Continued)

(52) U.S. Cl.

CPC ..... *F04D 29/624* (2013.01); *A47L 15/4257* (2013.01); *A47L 15/486* (2013.01); *F04D 17/08* (2013.01); *F04D 29/083* (2013.01); *F04D 29/4206* (2013.01); *F04D 29/668* (2013.01)

(58) Field of Classification Search

CPC ..... F04D 29/624; F04D 17/08; F04D 29/083; F04D 29/4206; F04D 29/668; A47L 15/42; A47L 15/4251; A47L 15/4257; A47L 15/486; A47L 15/488

See application file for complete search history.

(56) References Cited

U.S. PATENT DOCUMENTS

| | | | | |
|---|---|---|---|---|
| 4,657,036 | A | 4/1987 | Yake | |
| 12,053,135 | B2 * | 8/2024 | Ohayon | A47L 15/4257 |
| 2015/0196188 | A1 | 7/2015 | Li et al. | |

(Continued)

FOREIGN PATENT DOCUMENTS

| | | | |
|---|---|---|---|
| CN | 104706295 A | * | 6/2015 |
| CN | 105832273 A | * | 8/2016 |

(Continued)

OTHER PUBLICATIONS

CN_104706295 translation (Year: 2015).*

(Continued)

*Primary Examiner* — Brian P Wolcott

(74) *Attorney, Agent, or Firm* — Dority & Manning, P.A.

(57) ABSTRACT

A door assembly for an appliance includes a blower assembly having a blower unit. The door assembly includes a door with an exterior wall and an interior wall. The exterior wall and the interior wall define a volume therebetween. The door assembly also includes a sealed compartment disposed within the volume. The blower assembly is housed within the sealed compartment and includes the blower unit, a cover removably mounted adjacent to an opening of the sealed compartment and adjacent to a portion of the exterior wall of the door, and a seal disposed between the blower unit and the cover. The cover includes a plurality of restraints configured to secure to the blower unit to provide at least three points of restraint between the cover and the blower unit. The sealed compartment is sealed from remaining portions of the volume via the cover and the seal.

15 Claims, 6 Drawing Sheets

(51) Int. Cl.
*F04D 29/42* (2006.01)
*F04D 29/66* (2006.01)

(56) References Cited

U.S. PATENT DOCUMENTS

| | | | | |
|---|---|---|---|---|
| 2023/0301482 | A1* | 9/2023 | Czarnecki | A47L 15/0034 |
| 2024/0081609 | A1* | 3/2024 | Zhu | A47L 15/4287 |

FOREIGN PATENT DOCUMENTS

| | | | | | |
|---|---|---|---|---|---|
| CN | 105832274 | A | * | 8/2016 | A47L 15/42 |
| CN | 207734126 | U | * | 8/2018 | A47L 15/4223 |
| CN | 104706295 | B | | 2/2019 | |
| CN | 110859578 | A | * | 3/2020 | |
| CN | 115363498 | A | * | 11/2022 | |
| CN | 218356152 | U | | 1/2023 | |
| EP | 3020319 | A1 | * | 5/2016 | A47L 15/486 |

OTHER PUBLICATIONS

CN_105832273 translation (Year: 2016).*
CN_105832274 translation (Year: 2016).*
CN_110859578 translation (Year: 2020).*
CN_115363498 translation (Year: 2022).*
CN_207734126 translation (Year: 2018).*

* cited by examiner

BLOWER UNIT FOR AN APPLIANCE

FIELD OF THE INVENTION

The present disclosure generally relates to appliances, and more particularly to a blower unit for an appliance door.

BACKGROUND OF THE INVENTION

Common household appliances may include dishwashers, washing machines, dryers, and other appliances. Such appliances are typically used for the cleaning and/or drying of dishes, clothes, and/or other items found in the household. Dishwashers and washing machines typically include a wash chamber or tub and a door assembly for selectively opening and closing the appliance. The door assembly is important in maintaining the integrity of the appliance during operation because the door assembly typically provides a seal to prevent leakage from the appliance. In addition, the door assembly may facilitate the control of airflows within the appliance, thereby affecting the drying performance during moisture removal operations.

Moreover, such appliances may include one or more blower fans and/or external heaters to improve overall drying performance. Such components, however, may be subject to high humidity and condensing environments. Furthermore, sealing of the compartment(s) containing the blower fan(s) can be challenging as cost pressure combined with a thin door thickness can create conflicting goals.

Accordingly, the present disclosure is directed to a door assembly for an appliance that contains a blower fan to address the aforementioned issues. More particularly, the present disclosure is directed to a door assembly that utilizes the blower fan as structure to provide flatness and rigidity to the otherwise flexible door assembly.

BRIEF DESCRIPTION OF THE INVENTION

Aspects and advantages of the invention will be set forth in part in the following description, or may be obvious from the description, or may be learned through practice of the invention.

In an aspect, the present disclosure is directed to a door assembly for an appliance. The door assembly includes a door having an exterior wall and an interior wall. The exterior wall and the interior wall define a volume therebetween. The door assembly also includes a sealed compartment disposed within the volume and a blower assembly housed within the sealed compartment. The blower assembly includes a blower unit, a cover removably mounted adjacent to an opening of the sealed compartment and adjacent to a portion of the exterior wall of the door, and a seal disposed between the blower unit and the cover. The cover includes a plurality of restraints configured to secure to the blower unit to provide at least three points of restraint between the cover and the blower unit. Further, the sealed compartment is sealed from remaining portions of the volume via the cover and the seal.

In another aspect, the present disclosure is directed to a method of assembling a door for a dishwasher appliance, the door having an exterior wall and an interior wall, the exterior wall and the interior wall defining a volume therebetween. The method includes providing a blower unit within a sealed compartment of the door, the sealed compartment being disposed within the volume. Further, the method includes mounting a cover to an opening of the sealed compartment, the cover comprising a plurality of restraints. Moreover, the method includes securing the plurality of restraints to the blower unit to provide at least three points of restraint between the cover and the blower unit.

In yet another aspect, the present disclosure is directed to a dishwasher appliance including a tub defining a wash chamber and a door having an exterior wall and an interior wall. The exterior wall and the interior wall define a volume therebetween. The dishwasher appliance also includes a vent duct disposed within the volume of the door, a sealed compartment disposed within the vent duct, and a blower assembly housed within the sealed compartment. The blower assembly includes a blower unit, a cover removably mounted adjacent to an opening of the sealed compartment and adjacent to a portion of the exterior wall of the door, and a seal disposed between the blower unit and the cover. The cover includes a plurality of restraints configured to secure to the blower unit to provide at least three points of restraint between the cover and the blower unit. Further, the sealed compartment is sealed from remaining portions of the volume via the cover and the seal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
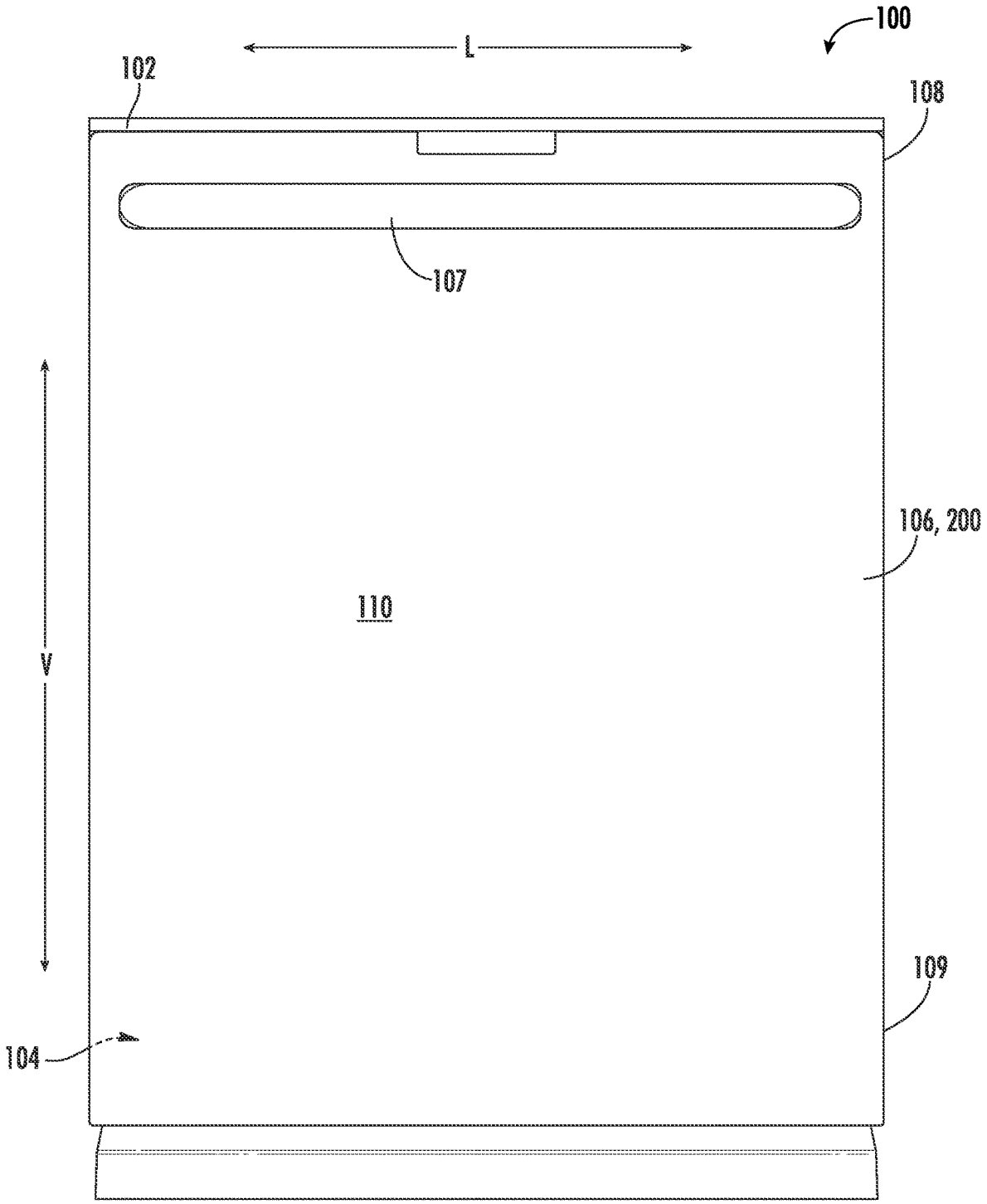
FIG. 1 provides a front view of an appliance, particularly a dishwasher appliance, in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first" and "second" may be used interchangeably to distinguish one component from another and are not intended to signify the location or importance of the individual components. Terms such as "interior" and "exterior" refer to relative directions with respect to the interior/inner and exterior/outer of the washing machine appliance, and in particular the wash basket therein. For example, "interior" or "exterior" refers to the direction towards the interior of the washing machine appliance. Terms such as "vertical," "lateral," "front," "top," or "bottom" are used for reference only as example embodiments disclosed herein are not limited to the vertical or lateral orientation shown nor to any particular configuration shown; other constructions and orientations may also be used. Furthermore, it should be appreciated that as used herein, terms of approximation, such as "substantially" or "about," refer to being within ten percent greater or less than the stated value or term of reference.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Figure 2:
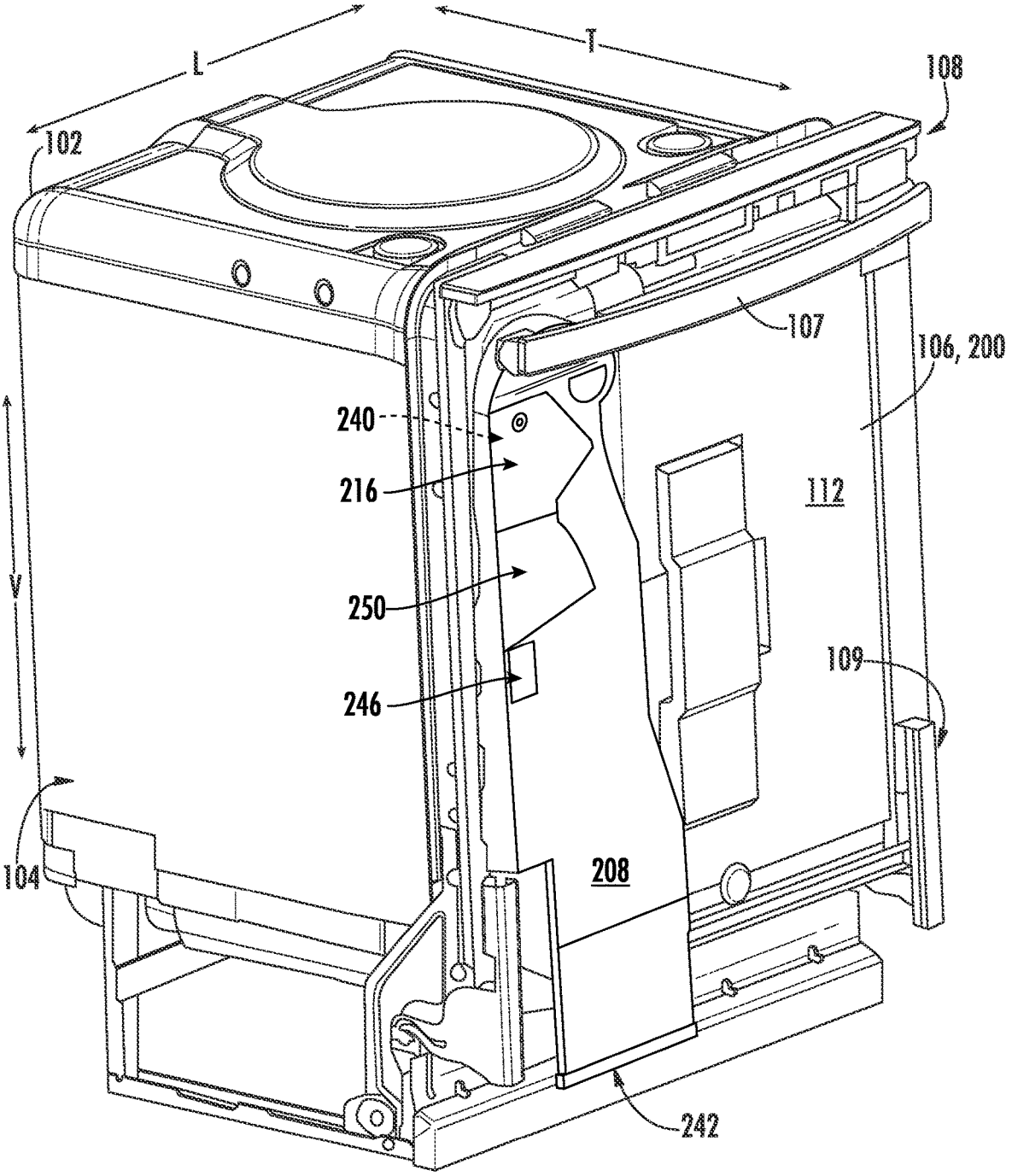
FIG. 2 provides a perspective view of the appliance of FIG. 1 with various exterior components removed to reveal a door assembly.

Referring now to the drawings, FIGS. 1 and 2 depict an example appliance, such as a dishwasher appliance 100, that may be configured in accordance with aspects of the present disclosure. In particular, FIG. 1 shows a front view of the dishwasher appliance 100 that may be configured in accordance with aspects of the present disclosure. FIG. 2 shows an internal, perspective view of the dishwasher appliance 100 of FIG. 1 with various exterior components removed to reveal a door assembly 200. Further, as shown, the dishwasher appliance 100 defines a vertical direction V, a lateral direction L, and a transverse direction T (FIG. 2). The vertical direction V, lateral direction L, and transverse direction T are mutually perpendicular and form an orthogonal direction system. It should be appreciated that the invention is not limited to any particular style, model, or other configuration of dishwasher, and that the embodiment depicted in FIGS. 1 and 2 is for illustrative purposes only.

As shown in FIGS. 1 and 2, the dishwasher appliance 100 includes a tub 102 that defines a wash chamber 104 within an interior of the tub 102. As such, the wash chamber 104 is configured for the receipt of articles for cleaning, such as dishes, cups, utensils, etc. As shown particularly in FIG. 1, the tub 102 includes a front opening (not shown) and a door assembly 200 with a handle 107. Further, as shown, the door assembly 200 includes a door 106 extending between a top portion 108 and a bottom portion 109 along the vertical direction V. Thus, in an embodiment, the door assembly 200 is hinged at or near the bottom portion 109 of the door assembly 200 for movement between a closed position (shown in FIG. 1) such that the wash chamber 104 is sealed shut for a washing operation and an open position for loading and unloading of articles to and from the wash chamber 104. In addition, as shown, the door 106 also has an exterior wall 110 and an interior wall 112.

In additional embodiments, the dishwasher appliance 100 may include various components for applying wash fluid onto articles within the wash chamber 104 and/or for supporting the articles within wash chamber 104. Such components are well known in the art and are not shown or described in detail herein. As an example, the dishwasher appliance 100 may include racks for supporting articles for washing within the wash chamber 104, spray assemblies for directing flows of wash fluid onto the articles within the racks, silverware baskets, etc. The racks may be adapted for movement between an extended loading position in which the racks are substantially positioned outside the wash chamber 104 and a retracted position in which the racks are located inside the wash chamber 104. The spray assemblies may include, for example, one or more rotatable spray arms mounted within the tub 102 and/or on one or more of the racks.

Figure 3:
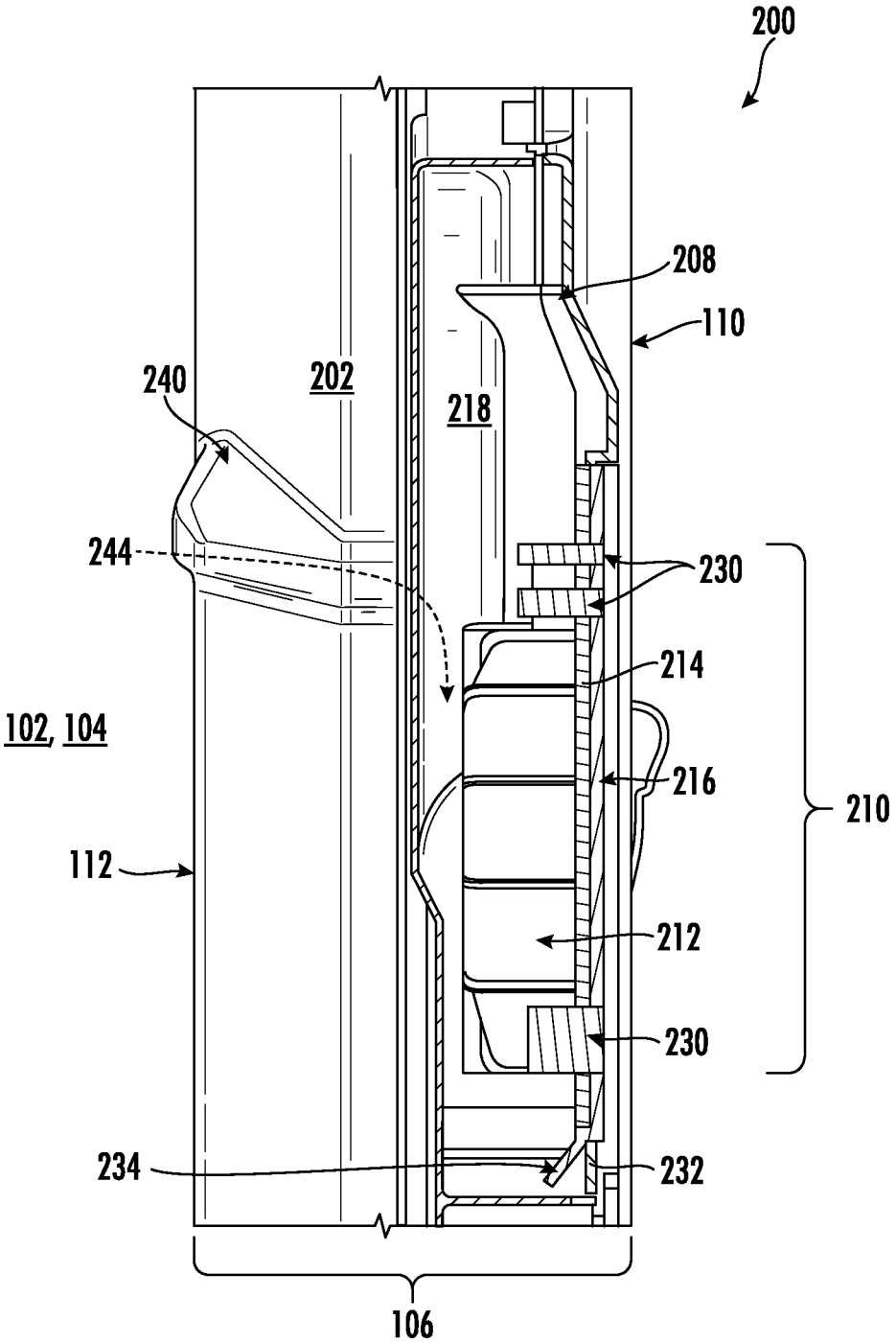
FIG. 3 provides a sectional, side view of the door assembly of FIG. 2.

Referring particularly to FIG. 2, the door assembly 200 includes a vent duct 208 positioned within the door 106. More specifically, as shown, the vent duct 208 is equipped with a door outlet 242 and a plurality of inlets, including an ambient inlet 246 (FIG. 2) and a door inlet 240 (FIG. 3). The vent duct 208 extends at least between the door inlet 240 (FIG. 3) and the door outlet 242. The ambient inlet 246 is positioned in fluid communication with ambient air around the tub 102. Thus, in an embodiment, the vent duct 208 may also be equipped with a motor operable to direct ambient airflow from around the tub 102 into the vent duct 208 through the ambient inlet 246, e.g., during operation of the ambient fan. As an example, as shown in FIG. 2, the motor described herein may be positioned beneath an ambient-motor cover 250. As such, in an embodiment, as shown, the door inlet 240 allows an airflow 244 (FIG. 3) from the wash chamber 104 to be directed into the vent duct 208 to mix with the ambient air drawn into the vent duct 208 via the ambient inlet 246. The ambient air can mix with the airflow 244 in the vent duct 208 to reduce humidity of the airflow 244 before the airflow 244 exits the door outlet 242. Further depicted in FIGS. 3-4, the blower unit 212 is configured to draw an airflow 244 from the tub 102 and/or wash chamber 104 through a door inlet 240 that extends through the interior wall 112 of the door 106. With additional reference to FIG. 2, the blower unit 212 directs the airflow 244 through the vent duct 208 within the volume 202 to the door outlet 242. In the vent duct 208, the airflow 244 mixes with ambient air entering into the vent duct 208 through the ambient inlet 246 before the airflow 244 exits out the door outlet 242.

Figure 4:
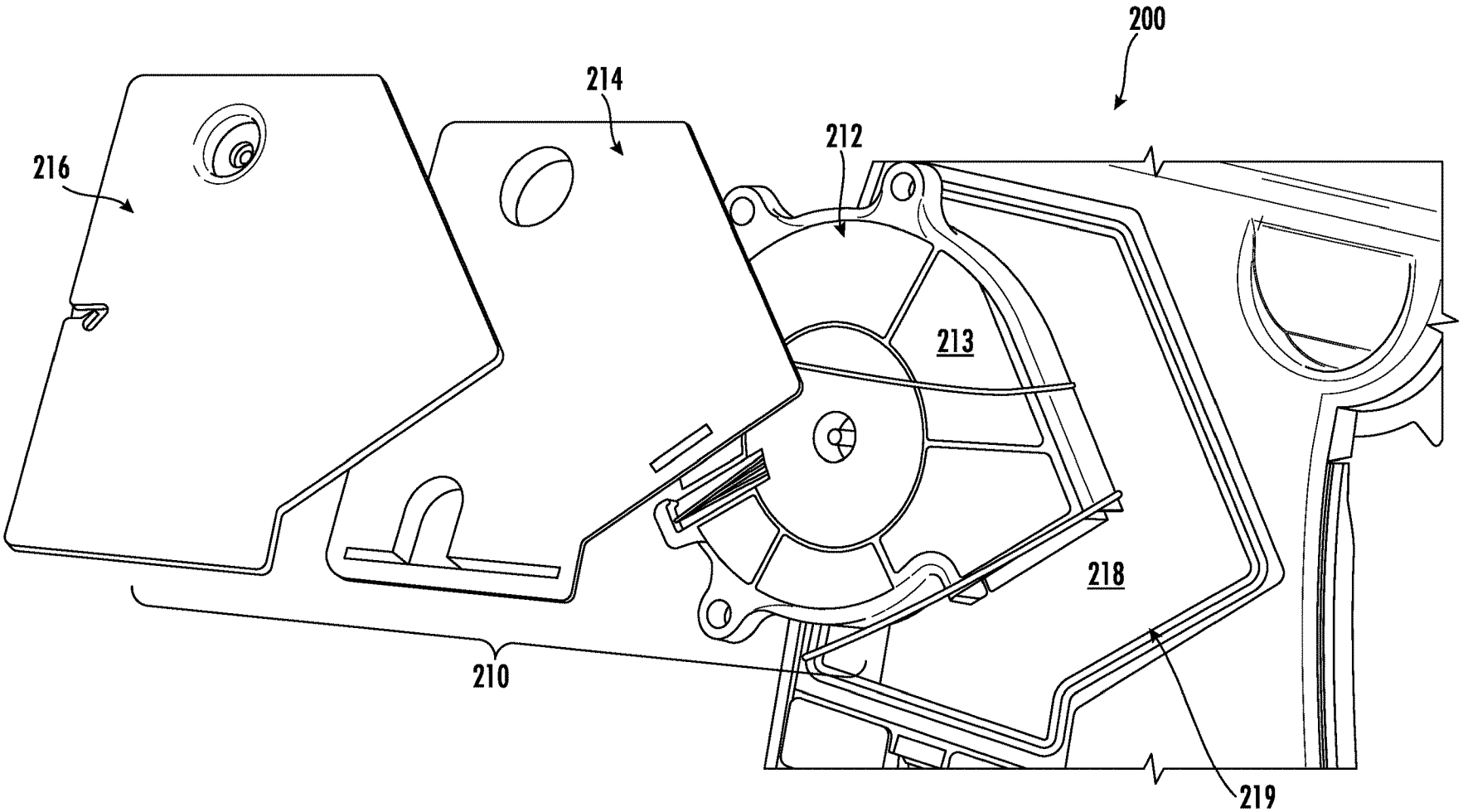
FIG. 4 provides an exploded view of a blower assembly for the door assembly of FIG. 2.

Referring now to FIGS. 2 and 3, in some embodiments, a portion of the vent duct 208 may be defined by a cover 216 mounted over a sealed compartment 218 defined within the vent duct 208. More specifically, as shown, the exterior wall 110 and the interior wall 112 of the door 106 define a volume 202 therebetween. Thus, as shown, the sealed compartment 218 is disposed within the volume 202 defined within the door 106. Further, as shown in FIGS. 3 and 4, a blower assembly 210 having a blower unit 212 is housed within the sealed compartment 218. Moreover, as shown, the cover 216 covers the blower assembly 210, whereas a seal 214 disposed between the blower unit 212 and the cover 216 seals the sealed compartment 218 from the wash chamber 104. In an embodiment, as shown in FIG. 3, a plurality of restraints 230 can extend from the cover 216. More specifically, the plurality of restraints 230 can extend through the seal 214 to secure to the blower unit 212, with the seal 214 being disposed between the blower unit 212 and the cover 216.

Figure 5:
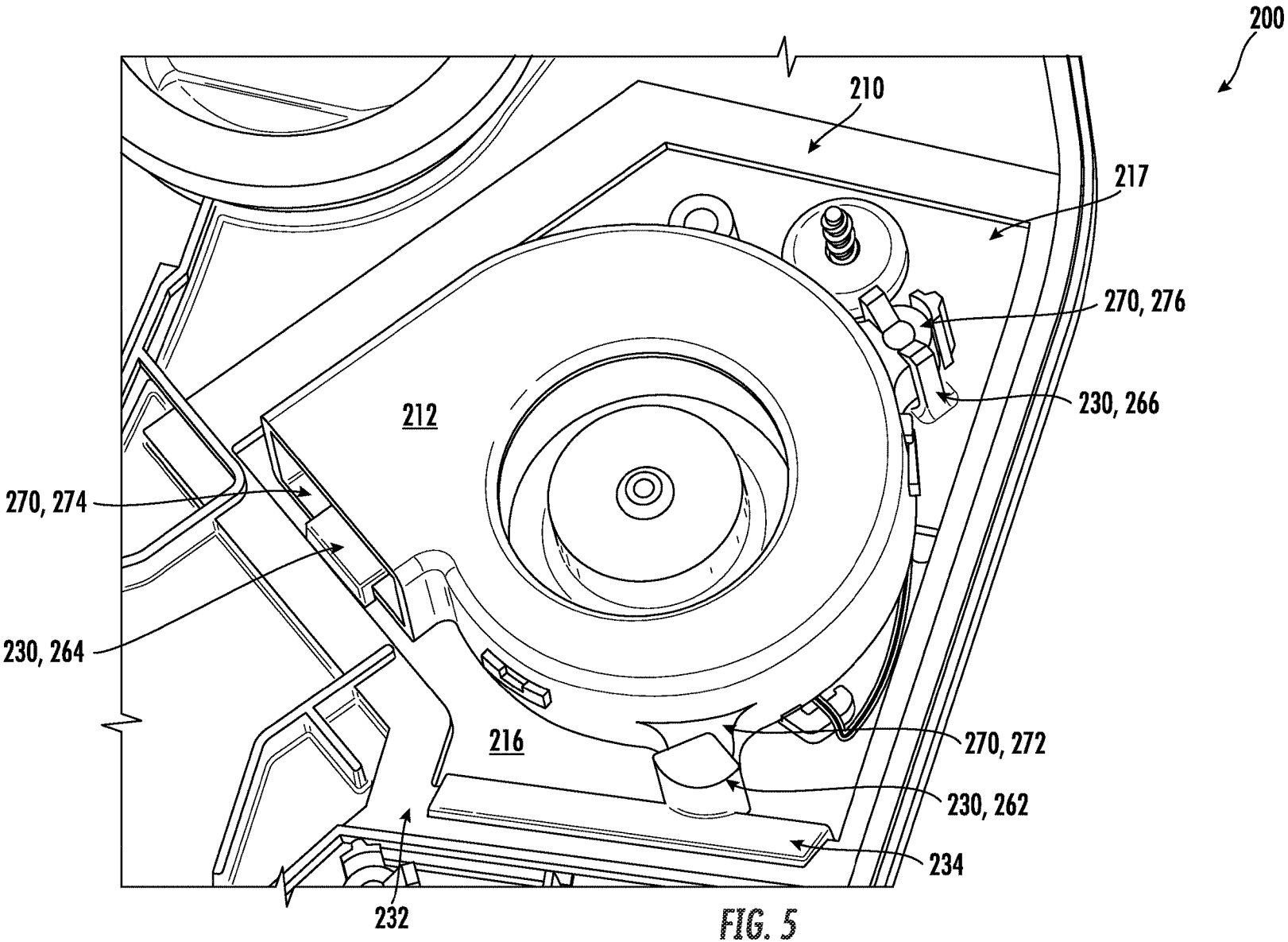
FIG. 5 provides a partial, internal, perspective view of the door assembly of FIG. 2.

Referring now to FIGS. 4 and 5, various views of components of the door assembly 200 according to the present disclosure are illustrated. In particular, FIG. 4 illustrates an exploded view of an embodiment of the cover 216 with respect to the vent duct 208 of the door assembly 200 according to the present disclosure. FIG. 5 illustrates a partial, internal perspective view of an embodiment of the blower assembly 210 of the door assembly 200 secured to an interior surface 217 of the cover 216 with the seal 214 omitted for clarity according to the present disclosure. Although the seal 214 is omitted for illustrative purposes, it is understood that certain embodiments may include the seal 214 spanning the entirety of the cover 216. In some embodiments, the seal 214 may span a portion of the cover 216, such that the seal 214 spans across only a surface 213 (FIG. 4) of the blower unit 212. Further, as shown in FIG. 4, the cover 216 is removably mounted adjacent to an opening 219 of the sealed compartment 218 and is adjacent to a portion of the exterior wall 110 of the door 106.

In certain embodiments, as shown in FIG. 5, the seal 214 substantially fills an interior space between the cover 216 and a surface 213 of the blower unit 212 to reduce vibrations in the door 106. Further, such configurations provide sealing of the sealed compartment 218 and the remaining portions of the volume 202 defined by the exterior wall 110 and the interior wall 112. Accordingly, the sealed compartment 218 is sealed from the remaining portions of the volume 202 via the cover 216 and the seal 214.

Referring still to FIG. 5, an interior surface of the cover 216 may further includes a rigid flap 234 configured to overlap at least a portion of a bottom edge 232 of the opening 219 (FIG. 4) of the sealed compartment 218. In such embodiments, the rigid flap 234 is configured to overlap and/or engage the bottom edge 232 for securing the cover 216 adjacent to the opening 219 of the sealed compartment 218.

Further, as shown in FIG. 5, in an embodiment, the cover 216 includes a plurality of restraints 230 configured to secure the cover 216 to the blower unit 212 of the blower assembly 210. In some embodiments, for example, the plurality of restraints 230 provide at least three points of restraint between the cover 216 and the blower unit 212. In other embodiments, however, the cover 216 may include more than three points of restraint, such as four points of restraint, five points of restraint, or more than five points of restraint for providing additional support and further securing the cover 216 and the blower unit 212. In further embodiments, the plurality of restraints 230 may be formed integrally with the cover 216 and extend therefrom and into the sealed compartment 218 (FIGS. 2-4). In this way, the arrangement of the cover 216 secured to the blower unit 212 via the plurality of restraints 230 with the seal 214 positioned therebetween supports flattening and stiffening of the door 106 due to even compression of the seal 214 between the cover 216 and the blower unit 212.

In addition, as shown in FIG. 5, the blower unit 212 can be equipped with a plurality of features 270 that are adapted to engage with a respective restraint of the plurality of restraints 230 of the cover 216. Accordingly, as illustrated in the embodiment of FIG. 5, for example, the plurality of restraints 230 may include a first restraint 262, a second restraint 264, and third restraint 266. Thus, as shown, the first, second, and third restraints 262, 264, 266 are adapted to receive first, second, and third features 272, 274, 276 of the plurality of features 270 of the blower unit 212, respectively. In some embodiments, as shown in FIG. 5, the plurality of features 270 can include projections, such as the first and third features 272, 276. The plurality of features 270 can also be defined by the existing blower unit, such as the third projection 276. As such, the first restraint 262 and the second restraint 264 engage with the first feature 272 and the second feature 274, respectively, to provide vertical retention to the blower unit 212. Furthermore, the third restraint 266 engages with the third feature 276 to restrict lateral movement of the cover 216. The plurality of features 270 of the blower unit 212 can include portions of the blower unit, such as an inlet, or extensions of the blower unit 212, such as rounded ridges or protrusions with holes extending therethrough. As such, the plurality of features 270 of the blower unit 212 are configured to engage with the plurality of features 270 of the cover 216 to restrict movement of and/or provide support to the blower assembly 210 and the features associated with the blower assembly 210, including but not limited to the blower unit 212, the seal 214, and/or the cover 216.

In some embodiments, the plurality of restraints 230 include at least one of a hook member, a snap member, a notch, a clasp, a groove, a recess, or combinations thereof. For example, as shown in the illustrated embodiment of FIG. 5, the first restraint 262 and the second restraint 264 are hook members, such as undercut hooks, adapted to receive the first feature 272 and the second feature 274, respectively. Moreover, as shown, the third restraint 266 may be a snap member with opposing snaps that secure the third feature 276 to the cover 216 when the third restraint 266 of the blower unit 212 is pressed against the cover 216. One skilled in the art will appreciate that any combination of the plurality of restraints 230 (e.g., snap, hooks, etc.) can be used in any combination for engaging with any of the plurality of restraints 270.

Figure 6:
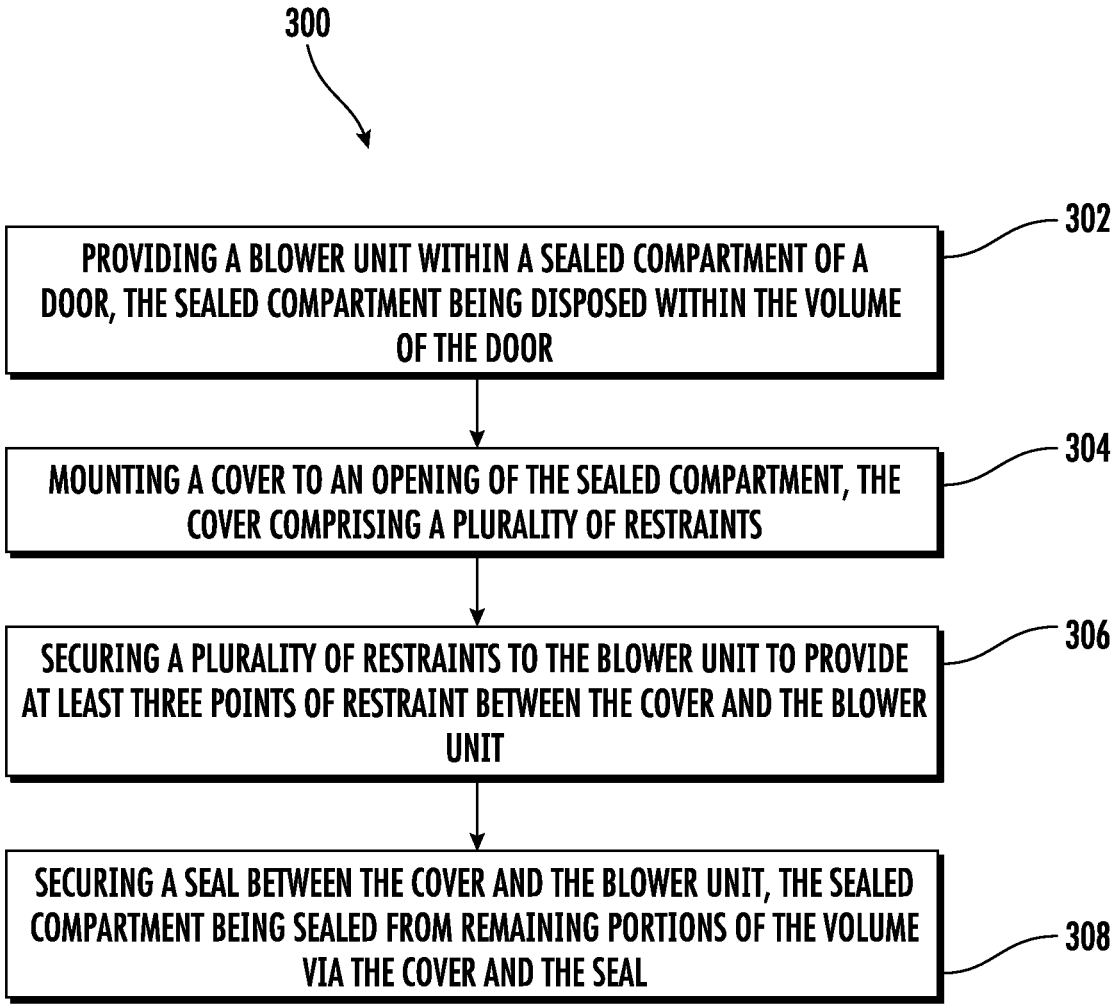
FIG. 6 provides a flow diagram of an embodiment of a method for assembling a door assembly for a dishwasher appliance according to the present disclosure.

Referring now to FIG. 6, a flow diagram of an embodiment of a method 300 for assembling a door assembly of a dishwasher appliance, such as the door assembly 200 described herein, according to the present disclosure is illustrated. In general, the method 300 will be described herein with reference to the door assembly 200 described herein. However, it should be appreciated that the disclosed method 300 may be implemented with any door and/or door assembly having any other suitable configurations. In addition, although FIG. 6 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown at (302), the method 300 includes providing a blower unit within a sealed compartment of a door of a door assembly. For example, according to an embodiment, the blower unit 212 of the blower assembly 210 can be provided within the sealed compartment 218 of the door 106 of the door assembly 200. As mentioned, the sealed compartment 218 is disposed within the volume 202 defined between the exterior wall 110 and the interior wall 112 of the door 106. As shown at (304), the method 300 includes mounting a cover to an opening of the sealed compartment. As explained above, the cover 216 of the door assembly 200 is mounted to the opening 219 of the sealed compartment 218. Further, the cover 216 includes the plurality of restraints 230, such as first, second, and third restraints 262, 264, and 266.

As shown at (306), the method 300 includes securing a plurality of restraints to the blower unit. For example, according to an embodiment, the plurality of restraints 230 can be secured to the blower unit 212 to provide at least three points of restraint between the cover 216 and the blower unit 212. Furthermore, in some embodiments, securing the plurality of restraints 230 to the blower unit 212 includes engaging the first and second restraints 262, 264 of the plurality of restraints 230 with first and second features 272, 274 of the plurality of features 270, respectively, to provide vertical retention to the blower unit 212. In such instances, the first and second restraints 262, 264 are adapted to receive the first and second features 272, 274, respectively. Moreover, the third restraint 266 of the plurality of restraints 230 engages with a third feature 276 of the plurality of features 270 to restrict lateral movement of the cover 216.

As shown at (308), the method 300 includes securing a seal between the cover and the blower unit. As explained above, the seal 214 of the blower assembly 210 is secured between the cover 216 and the blower unit 212. In this way, the sealed compartment 218 is sealed from remaining portions of the volume 202 via the cover 216 and the seal 214.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A door assembly for an appliance, the door assembly comprising:

a door having an exterior wall and an interior wall, the exterior wall and the interior wall defining a volume therebetween;

a scaled compartment disposed within the volume; and a blower assembly housed within the sealed compartment, the blower assembly comprising:

a blower unit;

a cover removably mounted adjacent to an opening of the sealed compartment and adjacent to a portion of the exterior wall of the door, the cover comprising a plurality of restraints configured to secure to the blower unit to provide at least three points of restraint between the cover and the blower unit; and a seal disposed between the blower unit and the cover, the sealed compartment being sealed from remaining portions of the volume via the cover and the seal, wherein the sealed compartment defines an interior space defined between the cover and an exterior surface of the blower unit, and wherein the seal substantially fills the interior space to reduce vibrations in the door and to provide sealing between the sealed compartment and the remaining portions of the volume defined by the exterior wall and the interior wall.

2. The door assembly of claim 1, wherein the plurality of restraints is formed integrally with the cover and extends therefrom into the sealed compartment.

3. The door assembly of claim 2, wherein the blower unit comprises a plurality of features adapted to engage with a respective restraint of the plurality of restraints.

4. The door assembly of claim 3, wherein the plurality of restraints comprises:

first and second restraints adapted to receive first and second features of the plurality of features of the blower unit, respectively, the first and second restraints engaged with the first and second features, respectively, to provide vertical retention to the blower unit; and at least a third restraint adapted to receive a third feature of the plurality of features of the blower unit, the third restraint engaged with the third feature to restrict lateral movement of the cover.

5. The door assembly of claim 1, wherein the plurality of restraints comprises at least one of a hook member, a snap member, a notch, a clasp, a groove, a recess, or combinations thereof.

6. The door assembly of claim 1, wherein the blower unit is configured to draw an airflow through a door inlet extending through the interior wall of the door and direct the airflow through a vent duct within the volume to a door outlet, and wherein an ambient air drawn into the vent duct mixes with the airflow in the vent duct before the airflow exits out the door outlet.

7. The door assembly of claim 1, wherein the cover further comprises a rigid flap configured to overlap at least a portion of a bottom edge of the opening of the compartment for securing the cover adjacent to the opening of the compartment.

8. The door assembly of claim 1, wherein an arrangement of the cover secured to the blower unit via the plurality of restraints and the seal supports flattening and stiffening of the door due to even compression of the seal between the cover and the blower unit.

9. The door assembly of claim 1, wherein the cover is disposed between the exterior wall of the door and the seal of the blower assembly.

10. The door assembly of claim 1, wherein the appliance comprises a dishwasher appliance.

11. A dishwasher appliance, comprising:

a tub defining a wash chamber; and a door having an exterior wall and an interior wall, the exterior wall and the interior wall defining a volume therebetween;

a vent duct disposed within the volume of the door;

a sealed compartment disposed within the vent duct; and a blower assembly housed within the sealed compartment, the blower assembly comprising:

a blower unit;

a cover removably mounted adjacent to an opening of the sealed compartment and defining at least a portion of the vent duct adjacent to the exterior wall of the door, the cover comprising a plurality of restraints configured to secure to the blower unit to provide at least three points of restraint between the cover and the blower unit; and a seal disposed between the blower unit and the cover, the sealed compartment being sealed from remaining portions of the volume via the cover and the seal, wherein the sealed compartment defines an interior space defined between the cover and an exterior surface of the blower unit, and wherein the seal substantially fills the interior space to reduce vibrations in the door and to provide sealing between the sealed compartment and the remaining portions of the volume defined by the exterior wall and the interior wall.

12. The dishwasher appliance of claim 11, wherein the plurality of restraints is formed integrally with the cover and extends therefrom into the sealed compartment.

13. The dishwasher appliance of claim 12, wherein the blower unit comprises a plurality of features adapted to engage with a respective restraint of the plurality of restraints, the plurality of restraints comprising:

first and second restraints adapted to receive first and second features of the plurality of features of the blower unit, respectively, the first and second restraints engaged with the first and second features, respectively, to provide vertical retention to the blower unit; and at least one third restraint adapted to receive a third features of the plurality of features of the blower unit, the third restraint engaged with the third features to restrict lateral movement of the cover.

14. The dishwasher appliance of claim 11, wherein the plurality of restraints comprises at least one of a hook member, a snap member, a notch, a clasp, a groove, a recess, or combinations thereof.

15. The dishwasher appliance of claim 11, wherein an arrangement of the cover secured to the blower unit via the plurality of restraints with the seal positioned therebetween supports flattening and stiffening of the door due to even compression of the seal between the cover and the blower unit.

* * * * *